United States Patent [19]

Lisica et al.

[11] 4,445,796

[45] May 1, 1984

[54] PRINT ELECTRODE CONTROL CIRCUIT

[75] Inventors: Vincent M. Lisica, Vestal; Charles O. Ross, Endicott, both of N.Y.

[73] Assignee: International Business Machines Corporation, Armonk, N.Y.

[21] Appl. No.: 388,804

[22] Filed: Jun. 16, 1982

[51] Int. Cl.[3] ..... B41J 3/20

[52] U.S. Cl. ..... 400/120; 219/216

[58] Field of Search ..... 400/119, 120; 219/216

[56] References Cited

U.S. PATENT DOCUMENTS

| | | | |
|---|---|---|---|
| 3,624,661 | 11/1971 | Shebanow et al. | 400/119 |
| 4,141,018 | 2/1979 | Mizuguchi et al. | 400/120 |
| 4,343,012 | 8/1982 | Knapp | 400/323 |
| 4,355,319 | 10/1982 | Takeuchi et al. | 400/120 |

FOREIGN PATENT DOCUMENTS

| | | | |
|---|---|---|---|
| 2551957 | 5/1976 | Fed. Rep. of Germany | 400/120 |
| 2651985 | 5/1978 | Fed. Rep. of Germany | 400/119 |
| 55-128478 | 10/1980 | Japan | 400/120 |
| 56-37179 | 4/1981 | Japan | 400/120 |
| 56-60269 | 5/1981 | Japan | 400/120 |
| 56-113477 | 9/1981 | Japan | 400/120 |

*Primary Examiner*—William Pieprz

*Attorney, Agent, or Firm*—Kenneth P. Johnson

[57] ABSTRACT

Circuit for selectively enabling energization of printing electrodes in sequence in a print head to achieve a more nearly constant current flow in the electrodes to thereby produce recorded marks of more uniform size. The formation of the electrodes into gated small groups reduces the maximum allowable current and, hence, the electromagnetic radiation. During traversal of the print head along a print line, a lagging electrode group or groups are enabled before the leading groups regardless of travel direction to minimize recording impedance for energized electrodes.

10 Claims, 6 Drawing Figures

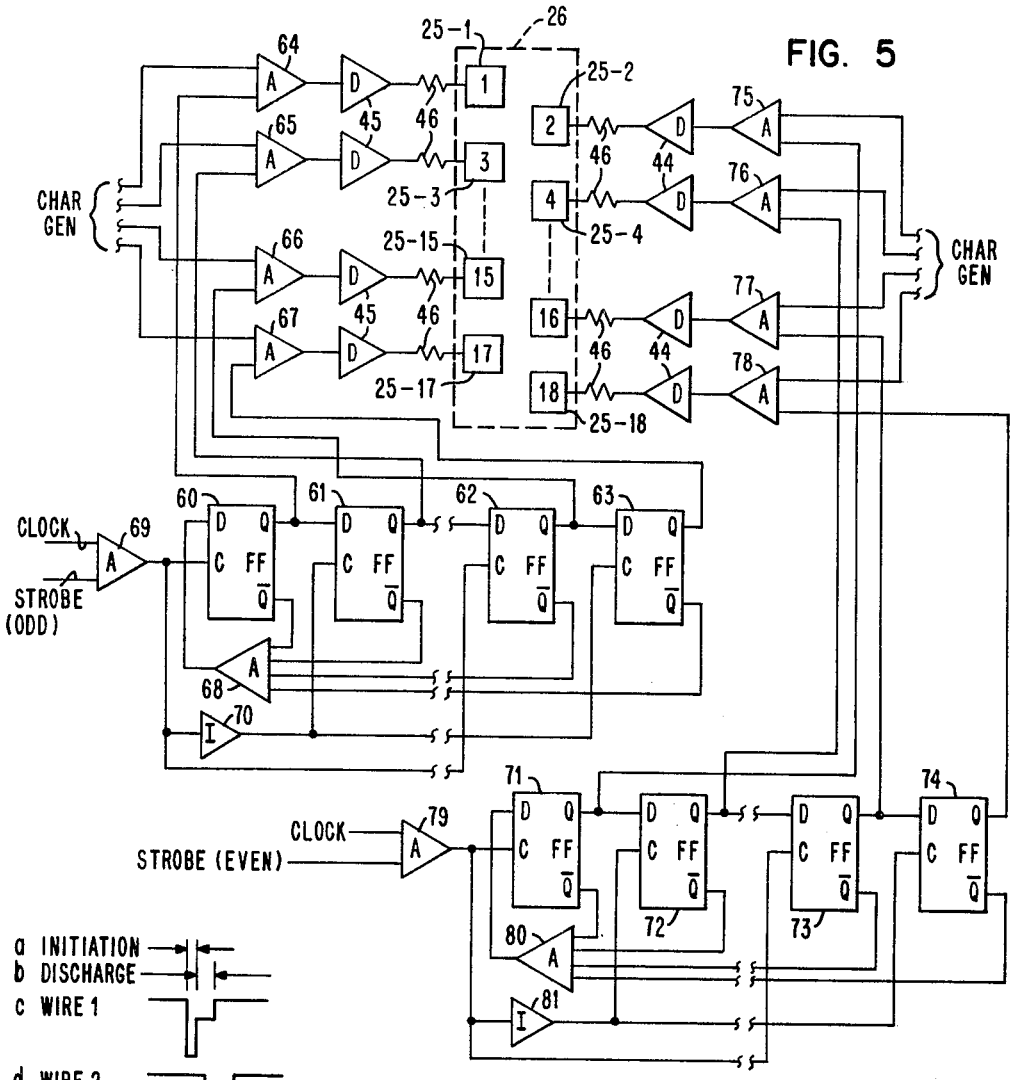
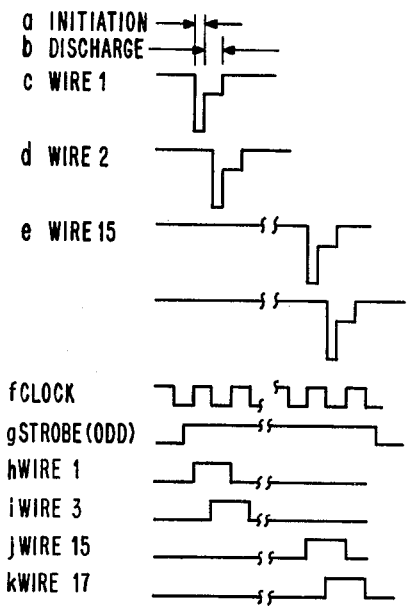
FIG. 6
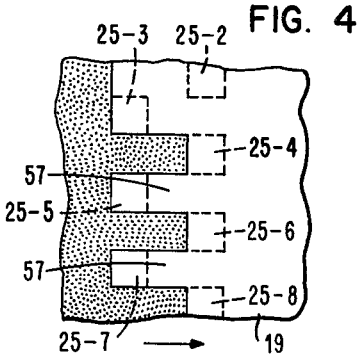

PRINT ELECTRODE CONTROL CIRCUIT

BACKGROUND OF THE INVENTION

This invention relates generally to printers and more particularly to a circuit for sequentially enabling electrode energization in an electroerosion printer.

In printers using metallized paper, the metal film is selectively removed by an electrical pulse through an electrode and the metal coating at the point of contact to thereby burn or evaporate the metal coating to leave the contrasting undercoat as a visible mark. Characters are usually formed by the selective energization of a plurality of electrodes as the record medium moves with respect to the print electrodes. In the past, electrode energization has been permitted to occur at any time the electrode received a timed data signal to be recorded. As a result, many electrodes could be fired simultaneously causing a much higher opposing voltage drop across the paper than that encountered with the firing of one or a few electrodes. The current to each electrode or stylus in the large group then is much less than with a small number of electrodes with the result that the intended burned area or dot is only partially formed.

One alternative to this problem is that described in U.S. Pat. No. 3,846,801 in which the plurality of electrodes must each fire individually by a multiplexing circuit. This arrangement has a severe limitation in that the current limiting resistor for controlling the amount of current at the burned area is in the return path from the paper and not in the individual stylus circuit. Thus, the single limiting resistor prevents satisfactory energization of more than one electrode and necessitates a long accumulative firing time to accommodate all electrodes in succession. In addition, there is no alternative to firing a single electrode at any particular instant.

When firing many electrodes at once, a further disadvantage is that of the transmitted electromagnetic radiation, ever present when marking occurs. The concurrent energization of a large number of electrodes results in greater current switching with resultant increase in the transmitted radiation or noise.

It has been found from experience that the current paths through the metal coating of the paper should be maintained as uniformly as possible for each electrode when fired. When the electrodes are arranged to follow one another along the print line and are traversing adjacent to an already recorded area, the firing of leading electrodes can frequently narrow the metal current path for a yet unfired lagging electrode thus creating an increased current path impedance on the paper for the latter electrodes. As a result, incomplete metal removal occurs, providing degraded printing quality.

OBJECTS AND SUMMARY OF THE INVENTION

It is accordingly a primary object of this invention to provide a circuit for more efficiently energizing the electrodes of a print head in a succession of enabled groups and thereby achieve improved marking and reduced electromagnetic radiation.

Another important object of this invention is to provide a circuit for controlling the electrodes of an electroerosion printer in which the electrodes are enabled to fire as a succession of groups during traversal along a print line with the lagging groups enabled for energization before the leading groups regardless of the direction of motion.

A still further object of this invention is to provide a circuit for controlling the energization of electrodes in an electroerosion printer in which electrodes are enabled to fire successively with each electrode so enabled prior to the completion of firing of a preceding electrode.

Yet another object of this invention is to provide a circuit for controlling the firing of electrodes in an electroerosion printer having improved current control to produce enhanced marking on the record member and reduce electromagnetic radiation.

The foregoing objects are attained in accordance with the present invention by providing means for producing a sequence of signals which enable in succession a plurality of gating means that are, in turn, connected to the driving circuits for print head electrodes. Each gating means becomes enabled with different ones of the signals from the sequence to permit its respective electrodes to respond to print data. The gating means are further connected to a direction signal that is operable to enable the gating circuit for the lagging electrodes prior to enabling the leading electrodes. When the electrode groups are moving in the opposite direction, a direction signal also responds to again enable the lagging electrodes first.

In a second embodiment of the invention, there is disclosed circuit structure for enabling the electrodes within a group to fire in overlapping sequence while maintaining the sequential control of the groups. A plurality of bistable means are controlled by the enabling signals and clocking signals in succession to further condition coincidence means at each of the marking electrodes.

The invention has the advantage of reducing the amount of current switched during recording to thereby better form the marks resulting from energization of the individual electrodes. In addition, the firing of lagging electrodes first minimizes the interaction among energized electrodes to further improve the marking capability of the electrodes. The reduced current of the control circuit also reduces electromagnetic radiation resulting from the arcing during recording. A division of the print head electrodes to a few smaller groups avoids the necessity for a lengthy period between the energization and firing of electrodes compared to when electrodes are fired individually. This allows the velocity of the electrodes to approach n times the velocity when electrodes are fired singly where n is the number of electrodes in a small group. The result is a much faster printer at a small increase in cost.

The foregoing and other objects, features and advantages of the invention will become apparent from the following more particular description of preferred embodiments of the invention, as illustrated in the accompanying drawing.

BRIEF DESCRIPTION OF THE DRAWING

FIG. 4 is a schematic diagram of the recording medium used in the printer of FIG. 1 showing the relationship of recorded and non-recorded areas and the recording electrodes;

FIG. 5 is a diagram of another embodiment of a circuit for controlling print electrodes in which the electrodes within a group are further enabled to fire in sequence when recording; and FIG. 6 is a timing diagram of waveforms for the circuit shown in FIG. 5.

DESCRIPTION OF THE PREFERRED EMBODIMENTS

Figure 1:
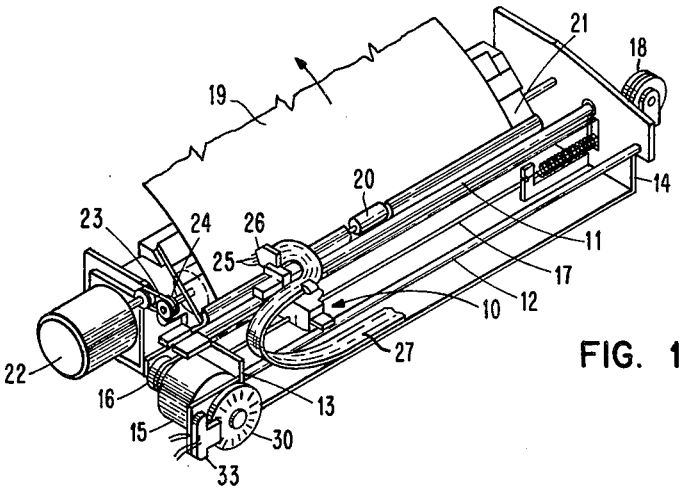
FIG. 1 is a perspective view of a serial matrix printer embodying a timing mechanism and reciprocating print elements with which the present invention is concerned.

Referring to FIG. 1, there is shown a serial matrix printer having a print head indicated generally as 10, movable along a print line on guide rods 11 and 12 fixed between side frames 13 and 14. The print head is translated along the print line by reversible servomotor 15 driving capstan 16 about which is wound cable 17 supported at the opposite end plate by tension pulley 18. A recording medium such as metallized paper 19 is gripped between a pressure roller 20 and a feed roll, indicated in phantom, and fed upwardly in the direction of the arrow over a platen 21. The feed roll is advanced by step motor 22, supported on side frame 13, driving belt 23 engaging the feed roll pulley 24 to advance the paper line by line.

Printing is accomplished by selectively energizing electrodes 25 extending from insulated block 26 as they rest against the metal coating on recording medium 19 during travel along the print line. The signals for energizing print electrodes or elements 25 are transmitted from a source not shown along ribbon cable 27 to the electrodes.

Figure 2:
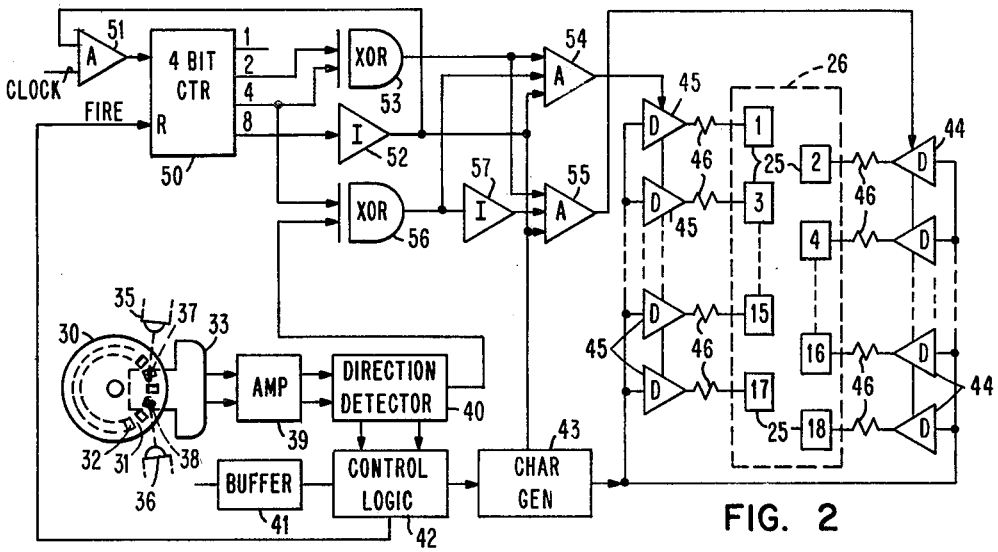
FIG. 2 is a diagram of a circuit constructed in accordance with the principles of the invention for generating enabling signals for groups of print electrodes in sequence according to direction.

The progression of the print head assembly 10 along the print line and its direction of motion are detected by an emitter disk 30, shown in greater detail in FIG. 2, having a band of alternating opaque and transparent areas 31, 32 near its periphery. The disk is supported on the shaft of motor 15 (FIG. 1) and thus moves synchronously with print head 10. In FIG. 2, a molded housing 33 supports a pair of light sources 35, 36 such as light emitting diodes on one side of disk 30 and a pair of sensors 37, 38 such as photo transistors on the opposite side of the disk. Each photo transistor has its respective light source and provides an output signal that varies with the intensity of the transmitted light that it senses through the disk grating during rotation. Two light source-transducer pairs are placed at the same radial distance from the disk hub but are spaced from each other along the band of opaque and transparent sectors so as to produce output signals that are in phase quardrature with each other. These signals are then processed through amplifier 39 and direction detection circuit 40, well known in the art, to provide timing signals and direction signals at control logic 42 for controlling the energization of the print elements 25 through flexible cable 27.

Referring to FIG. 2, there is shown a circuit for controlling electrodes 25 of print head 26, indicated in phantom, as two groups of electrodes to be fired in succession. Electrodes 25 are arranged in parallel rows that are normal to the direction of motion of print head 26 along the print line. The electrodes 25 are designated as odd or even, with electrodes 25-1, 25-3, 25-17 being the odd electrodes and 25-2, 25-5, 25-18, etc. being the even electrodes. Recording occurs on the record medium by the receipt of input data at a buffer 41, transmitted through control logic 42 to a character generator 43. The input buffer operates in typical fashion by designating within character generator 43 the already stored data to be supplied in sequence to the respective electrodes to produce marking of the record medium and form the characters desired. The print head is operable in a bidirectional manner; that is, printing can occur during travel in either direction. Control logic 42, in response to signals from direction detection circuit 40, defines the time and sequence in which the signals from character generator 43 are supplied to even drivers 44 and odd drivers 45 of the respective even and odd electrodes. Timing signals from circuit 40 gate the appropriate columns of matrix signals concurrently to the driver circuits of both the even and odd electrodes. Each electrode includes its individual current limiting resistor 46 which defines the amount of current supplied during each energization period.

Electrodes 25 are effective for marking the record member only when conditioned or enabled for recording the data from character generator 43. In this embodiment, the odd electrodes 25-1 to 25-17 and even electrodes 25-2 to 25-18 are enabled as separate groups. During travel of print head 26 from left to right along the print line, the odd electrodes are enabled first as the lagging electrodes and thereafter the even electrodes are enabled. However, during travel from right to left in the opposite direction, the even electrodes 25-2 to 25-18, now lagging, are energized before the odd electrodes.

The sequential control of the electrode groups is accomplished by the remaining portion of the circuit in FIG. 2. This circuit includes a 4 bit counter 50 which is advanced by clock pulses from a clock, not shown, through coincidence gate 51 that is conditioned through inverter 52 coupled to the 8 bit output terminal of the counter so that gate 51 is blocked at any time the 8 bit is on. Counter bits 2 and 4 are both connected to exclusive OR gate 53 whose output is provided as one input to each of coincidence gates 54 and 55. The 4 bit terminal of counter 50 is one input to exclusive OR circuit 56 whose other input is a signal from direction detector circuit 40 indicating by binary signal level the direction of movement of the print head along a print line. The output of exclusive OR circuit 56 is supplied directly to coincidence gate 54 and through inverter 57 as an input to coincidence gate 55. The 8 bit output of counter 50 from inverter 52 is supplied to both coincidence gates 54 and 55 as a third conditioning signal thereto and further supplied as an iput to character generator 43.

Figure 3:
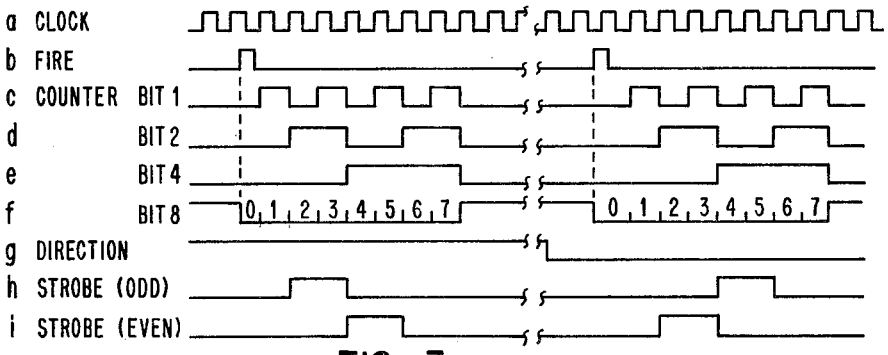
FIG. 3 is a timing diagram of waveforms for the circuit shown in FIG. 2.

For describing the operation of the circuit in FIG. 2, it may be assumed that counter 50 is presently idling with the 8 bit output on because of the suppression from inverter 52 to coincidence gate 51 preventing the advance of counter 50 by clock pulses. Further assume that the print head has been returned to the left end for starting a new line of printing from left to right. When the phase quadrature signals from emitter disk 30 and its photo detector assembly are supplied through amplifier 39 to direction detector 40, a signal level indicating the new direction from left to right is issued from circuit 40 to exclusive OR circuit 56. Control logic 42 also responds to the sensing of timing slot 32 and the timing and direction signal from circuit 40, which indicates printing can proceed, by issuing a fire pulse which resets counter 50 thus turning off the 8 bit output. This enables clock pulses from gate 51 to advance counter 50 through its counting sequence. A clock output is indicated at waveform a in FIG. 3 and a fire pulse is indicated at waveform b.

As the counter is advanced by clock pulses through counts 0–7, the signal levels at the various bit outputs are indicated in waveforms c-f. The turning off of bit 8 through inverter 52 provides an enabling signal at each of gates 54 and 55 and provides an access period for character generator data between count 0 and count 2 on waveform f prior to the lagging strobe on waveforms h or i. This reduces power applied to the character generator, improving reliability. At a count of 2 at exclusive OR circuit 53, with the bit 4 output still off, the exclusive OR circuit 53 provides an activating signal to both gates 54 and 55. The absence of an output from the bit 4 terminal counter 50 also enables an output from exclusive OR circuit 56, assuming the direction signal level as indicated in waveform g so that gate 54 thus is fully enabled and a strobe output therefrom gates all odd drivers 45 for firing by any signals present from character generator 43. This enabling output from gate 54 is shown in waveform h as a strobe pulse for the odd wires that lasts for two bit times.

When counter 50 has been advanced to a count of 4, bit 2 goes off and thus exclusive OR circuit 53 still continues to provide an activating signal to both gates 54 and 55. However, the output from bit 4 to exclusive OR circuit 56 terminates the output from the latter so that the output from inverter 57 enables gate 55 which is effective to provide a strobe signal for enabling drivers 44 for even electrodes 25-2 to 25-18. Subsequently at a count of 6 both bits 2 and 4 will be turned on at exclusive OR circuit 53 thereby blocking both gates 54 and 55. The counter then sits at a count of eight until the next fire pulse. The occurrence of a fire pulse is repeated with each slot 32 sensed so that printing can occur for each increment of travel as long as buffer 41 supplies data to be printed.

It will be noted that the circuit of FIG. 2 can easily be modified for operation with a uni-directional printer by omitting exclusive OR circuit 56 and inverter 57. Thus coincidence gates 54 and 55 each require only two inputs. The odd and even electrodes are enabled in succession for only the single selected printing direction in this case.

It will be seen in the foregoing that the trailing electrodes are enabled as a group to fire with character generator signals prior to the leading electrodes. Further, instead of a typical arrangement of enabling all print electrodes to fire when so energized by the character generator signals, the number of enabled electrodes is reduced to a smaller group thereby reducing the amount of marking current to be controlled. It will be also noted that when the direction changes, assuming that the print head has reached its limit of travel at the right so that it returns toward the left, the direction signal of waveform g changes levels and thus will have the opposite effect on the output from exclusive OR circuit 56 and allow drivers 44 to fire first. This condition is noted by the waveforms at the right in FIG. 3 wherein the strobe signal for the even electrodes, that is, from gate 55, occurs before the strobe pulse for the odd wires from gate 54. Thus, during the absence of an output from the bit 4 terminal at counter 50, no output is provided from exclusive OR circuit 56 so that gate 55 is fully conditioned by inverter 57 after the counter has been reset and counted to at least 2. When the counter reaches 4, however, exclusive OR 56 provides an output that is operable to produce a signal from gate 54, terminating the output from gate 55 so that the odd drivers 45 are each enabled.

The purpose of firing the lagging electrodes first is illustrated in FIG. 4 wherein even electrodes 25-2 to 25-8 are shown in phantom at the right and odd electrodes 25-3 to 25-7 are shown on the left trailing the even electrodes when motion of the print head with respect to the record medium 19 is assumed to be in the direction of the arrow. It will be noted that peninsulas 57 of conductive metal coating on the paper exist between the even electrodes 25-4 and 25-6 and between 25-6 and 25-8. In this illustration, if the even electrodes are fired simultaneously or before the lagging electrodes, these peninsulas would be even longer thus narrowing the circuit paths of conductive metal and increasing their length from the odd electrodes to the main body of the metal coating. Frequently the erosion of the metal layer, indicated by the stippled area, is not idealized as shown but is quite irregular and can neck down the peninsulas to even isolate the metal under the odd electrodes. To minimize this possibility, therefore, it is desirable to fire the trailing electrodes prior to the leading electrodes to improve the probability that the impedance of the path from the trailing electrodes to the main metal coating is as low as possible.

A second embodiment of a circuit for controlling the firing of odd and even electrodes is shown in FIG. 5 wherein the electrodes within a group that is either the odd or the even electrodes, are fired in overlapped succession during the gating or strobing time for the group.

This circuit has the advantage of allowing the high initiation current to subside in a fired electrode by waiting until after the initiation portion is terminated before turning on a second electrode. The shape of the current pulse through an electrode is illustrated in FIG. 6, waveforms a-e. Initially a heavy current of short duration flows through the electrodes but rapidly decreases to a flow of much less current and somewhat longer duration. During this latter discharge portion as seen from waveform c, the firing of a next electrode in the sequence can occur. The overlapping technique results in a decrease in the total time for gating all the electrodes in succession in either the odd or even banks thus allowing for a higher printing speed with larger "banks" of wires.

In FIG. 5, print head 26, the electrodes 25, their limiting resistors 46 and drivers 44 and 45 are identical with the same reference numerals as in FIG. 2. Each bank of electrodes, odd and even, is controlled by a series of flip flops which provide gating pulses which are overlapped with respect to a preceding pulse. For the odd electrodes, flip flops 60–63 are connected such that their Q outputs are connected to the next succeeding flip flop with the exception of the flip flop 63 whose output is not connected to the conditioning input of flip flop 60. The Q outputs of each flip flop are connected to a respective one of coincidence gates 64–67 which are, in turn, used to control a respective one of the drivers 45 for the odd electrodes 25-1 to 25-17. Each $\overline{Q}$ output of flip flops 60–63 is connected to a coincidence gate 68 such that when flip flops 60–63 are all off the gate conditions the input of flip flop 60 for switching. The flip flops are switched by combination of the clock signal and strobe signal for the odd electrodes at coincidence gate 69. Thus, when the odd electrodes are to be energized, clock pulse gate 69 results in the switching of flip flop 60 so that it conditions gate 64 to permit any signal from the character generator to activate the driver and electrode 25-1. Since flip flop 60 turned on, flip flop 61 is next conditioned and it is switched by the clock pulse of opposite polarity through inverter 70, while flip flop 60 still remains on for a half clock cycle. These signal relationships can be seen from the waveforms in FIGS. *6f–6k*. At the next positive going clock cycle from gate 69, flip flop 60 will be turned off and flip flop 62 will be turned on since it was conditioned by the output of flip flop 61. As each flip flop is turned on, it conditions its respective gate 65–67. It will be noted that this enables the firing of the respective odd electrodes to be initiated before the termination of current through a preceding odd electrode.

The even electrodes are controlled for successive firing by flip flops 71–74 connected to respective gates 75–78. Again, the clock pulses combined with an even strobe pulse at coincidence gate 79 serve to turn on flip flops 71–74 in succession as described above. As already mentioned, equivalent gate 80 uses the $\overline{Q}$ outputs of each of the flip flops to condition the first flip flop for turn on. Likewise, inverter 81 serves the same function as with the circuit for odd electrodes.

It may be noted from the foregoing description with respect to FIG. 5 that the flip flop outputs can be connected as enabling signals to two or more electrodes thus requiring less firing time but still maintaining relatively low switching currents. With respect to FIG. 2, other bit count combinations or counter capacities can be used to control additional groups of electrodes. Another modification is that of controlling the two or three electrodes within a group to be enabled in overlapped succession.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In a printer having a print head with at least two pluralities of print elements thereon and being movable along a print line on a record member with said pluralities moving in tandem, an energizing circuit for said print elements comprising:

data means for supplying data signals for recording to selected ones of said print elements when enabled;

means for generating sequencing signals, said generating means including a counter and means responsive to predetermined increments of motion of said print head along said print line for initiating said sequencing signals from said counter means;

enabling means responsive to predetermined ones of said sequencing signals for providing enabling signals for said data means to enable said pluralities of elements in succession with the lagging plurality being enabled first.

2. Apparatus as described in claim 1 wherein said counter means includes a binary counter and an exclusive OR circuit connected to predetermined ones of the output stages of said binary counter for providing said enabling signals in sequence.

3. Apparatus as described in claim 1 wherein said print head is bi-directional and said apparatus includes means for enabling the lagging plurality first irrespective of direction.

4. Apparatus as described in claim 1 including means for further enabling the electrodes within a plurality to be enabled in succession.

5. Apparatus as described in claim 4 wherein the print elements further enabled are enabled in overlapped succession within a said plurality.

6. A control circuit for energizing print elements to mark a recording medium in a printer comprising:

a print head movable along a print line adjacent to said recording medium and carrying said print elements arranged in at least two pluralities in tandem and energizable, when enabled, to mark said medium;

data means for supplying data signals to selected ones of said print elements for recording;

means for generating a repetitive sequence of timing signals; and enabling means responsive to predetermined ones of said timing signals in a sequence for providing enabling signals for said print elements operable to enable said print element pluralities in succession, with the lagging one of said pluralities being enabled first.

7. Apparatus as described in claim 6 wherein said print head is reciprocable along said print line and said apparatus further includes means for providing a signal indicating the direction of movement of said print head and means responsive to said direction signal for controlling said enabling means to first supply said enabling signals to the lagging plurality of elements irrespective of the direction of said print head.

8. Apparatus as described in claim 7 wherein said direction responsive means includes an exclusive OR circuit.

9. Apparatus as described in claim 6 further including means responsive to the enabling of a said plurality for further enabling the elements within a said plurality to be energized in at least partially overlapped succession with respect to a preceding element.

10. Apparatus as described in claim 9 wherein said print head is reciprocable along said print line and further includes means for generating a signal indicating the direction of movement of said print head and means responsive thereto for controlling said enablin signal means to first enable the lagging plurality of elements during a traversal of said print head irrespective of direction.

* * * * *